US007237503B2

(12) United States Patent
Stepp

(10) Patent No.: US 7,237,503 B2
(45) Date of Patent: Jul. 3, 2007

(54) PROTECTIVE PLATFORM FOR A BOAT

(75) Inventor: Steve Stepp, Lake Mary, FL (US)

(73) Assignee: Stagecoach Adventures, Inc., Carson City, NV (US)

( * ) Notice: Subject to any disclaimer, the term of this patent is extended or adjusted under 35 U.S.C. 154(b) by 0 days.

(21) Appl. No.: 11/242,400

(22) Filed: Oct. 3, 2005

(65) Prior Publication Data

US 2006/0137594 A1 Jun. 29, 2006

Related U.S. Application Data

(63) Continuation-in-part of application No. 29/220,387, filed on Dec. 28, 2004, now Pat. No. Des. 515,009.

(51) Int. Cl.
*B63B 17/00* (2006.01)

(52) U.S. Cl. ..... 114/361; 114/362

(58) Field of Classification Search ..... 114/361, 114/362

See application file for complete search history.

(56) References Cited

U.S. PATENT DOCUMENTS

| | | | | |
|---|---|---|---|---|
| D253,999 | S | 1/1980 | Richards et al. | |
| 4,495,883 | A | 1/1985 | Hoy | |
| 4,669,414 | A | 6/1987 | Molino | |
| 4,823,910 | A * | 4/1989 | Day | 182/84 |
| 4,964,358 | A * | 10/1990 | Sandrow | 114/368 |
| D312,440 | S | 11/1990 | Svensson | |
| 5,025,747 | A | 6/1991 | Grayson | |
| 5,170,740 | A | 12/1992 | Rottschafer | |
| 5,613,462 | A | 3/1997 | Schwartz | |
| 5,632,224 | A | 5/1997 | Schneider | |
| 5,829,380 | A * | 11/1998 | Smith | 114/362 |
| 6,119,615 | A * | 9/2000 | Porat | 114/85 |
| 6,302,050 | B1 * | 10/2001 | Ziehm | 114/343 |
| 6,983,823 | B1 * | 1/2006 | Zumbrunnen | 182/49 |
| 2003/0041792 | A1 | 3/2003 | Besenzoni | |
| 2005/0016439 | A1 * | 1/2005 | Mardikian et al. | 114/362 |

* cited by examiner

*Primary Examiner*—Stephen Avila
(74) *Attorney, Agent, or Firm*—Michael L. Leetzow, P.A.

(57) ABSTRACT

A protective platform is disclosed that includes a panel that moves from a first position to a second position. In the second position, the protective platform may protect swimmers from the rotating propeller of the boat and provides a way for swimmers to enter and/or exit the boat. The protective platform may also cover the swim platform in its entirety.

21 Claims, 8 Drawing Sheets

PROTECTIVE PLATFORM FOR A BOAT

This application is a continuation-in-part application of application Ser. No. 29/220,387, now U.S. Pat. No. D 515,009, filed on Dec. 28, 2004, which is incorporated by reference herein in its entirety.

BACKGROUND OF THE INVENTION

1. Field of the Invention

The present invention relates generally to a protective platform for the rear portion of a boat, more specifically, a protective platform to protect swimmers from the propeller on a boat and to provide an entrance to and exit from the stern of a boat.

2. Technical Background

As known to recreational boaters, a rotating propeller (and sometimes even a stationary one) on the back of a boat can present serious risks to those climbing in or out of the boat. Injuries from contact with a rotating propeller may be as minor as cuts or scratches or may even result in death. There are several technologies available to try to reduce the number of accidents involving rotating propellers. These technologies generally include propeller guards, propulsion alternatives, interlocks, and sensors. Propeller guards may include deflection type, full cages, and shrouds or ring guards. However, propeller guards generally have a negative impact on handling characteristics of the boat, loss of power and/or speed, and increase drag thereby reducing speed and fuel economy. They may even increase the frequency of blunt force trauma to swimmers or marine life due to their larger size. Additionally, the majority of propeller guards only protect from side entry, and not from fore or aft entry by swimmers. If a full cage is used, it presents a larger area for swimmers and/or debris to become entangled in the cages. The cages also cause hydrodynamic interference, potentially causing the loss of maneuverability and/or stability.

Interlocks also provides some protection, however, they do not always provide protection to swimmers trying to get back into a boat while the propellers are rotating. Sensors also provides some protection, but typically the swimmer must be wearing a monitoring device which interacts with a system on the boat. These systems may be expensive and require testing and maintenance.

Therefore, a protective platform and water exit is needed that can be easily installed on new boats or even added to older boats.

SUMMARY OF THE INVENTION

To achieve these and other advantages and in accordance with the purpose of the invention as embodied and broadly described herein, the invention is directed in one aspect to a protective platform to protect swimmers from a boat's propeller that includes a panel movably attached to the stern of the boat, the panel movable between a first position and a second position, the second position at least partially providing protection to swimmers from the boat's propeller, and at least one stepping surface on the panel to assist the swimmers from the water to a swim platform on the boat.

In another aspect, the invention is directed to a movable cover for a swim platform on a boat that includes a panel for covering at least a portion of a swim platform on a boat, at least one hinge rotatably connecting the panel to the boat, a stepping surface on a surface of the panel, and a mechanism to move the panel between a first position and a second position.

In yet another aspect, disclosed herein is a movable cover for a boat that includes a panel for covering at least a portion of a rear portion of a boat, a stepping surface attached to a surface of the panel, and a mechanism to move the panel between a first position to a second position.

In another aspect, the invention is directed to a movable cover for a swim platform in a boat that includes at least one panel for covering at least a portion of a swim platform in a boat, at least one hinge rotatably connecting the at least one panel to the boat, a stepping surface on a surface of the at least one panel, and a mechanism to move the at least one panel between a first position and a second position.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
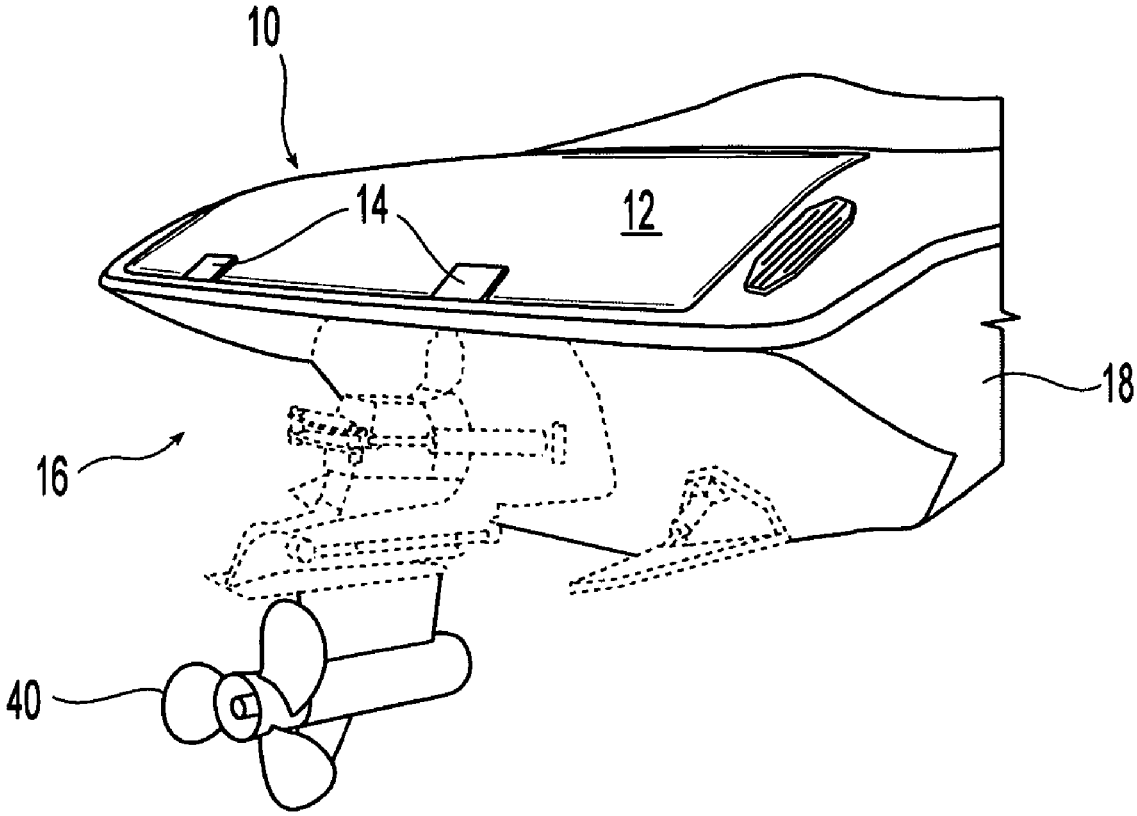
FIG. 1 is a rear perspective view of a first embodiment of a protective platform according to the present invention in a first position.

Reference will now be made in detail to the present preferred embodiments of the invention, examples of which are illustrated in the accompanying drawings. Whenever possible, the same reference numerals will be used throughout the drawings to refer to the same or like parts. One embodiment of the present invention is shown in FIG. 1 and is designated generally throughout by the reference numeral 10.

Figure 3:
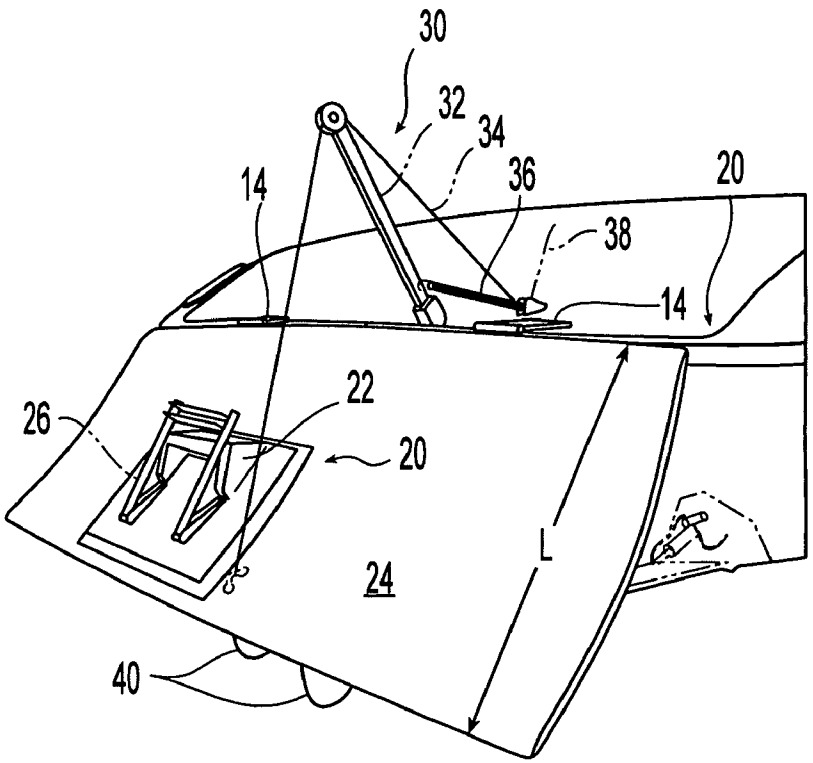
FIG. 3 is a perspective view of the protective platform of FIG. 1 in a second position.
Figure 2:
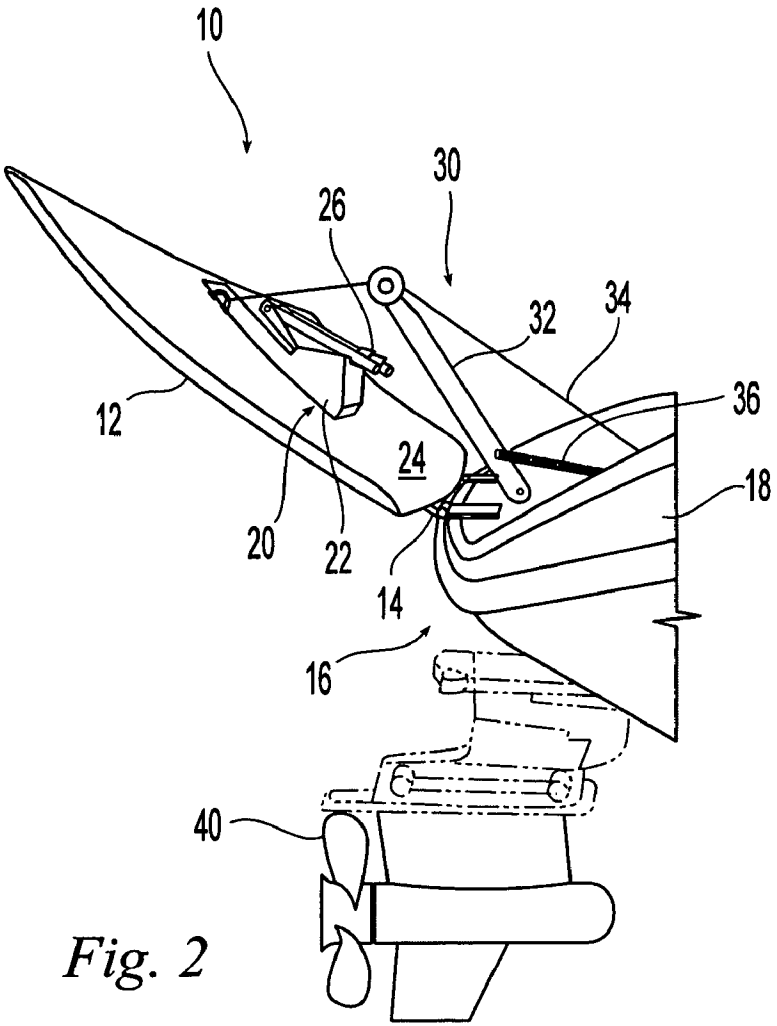
FIG. 2 is a right side elevational view of the protective platform of FIG. 1 between a first and second position.
Figure 4:
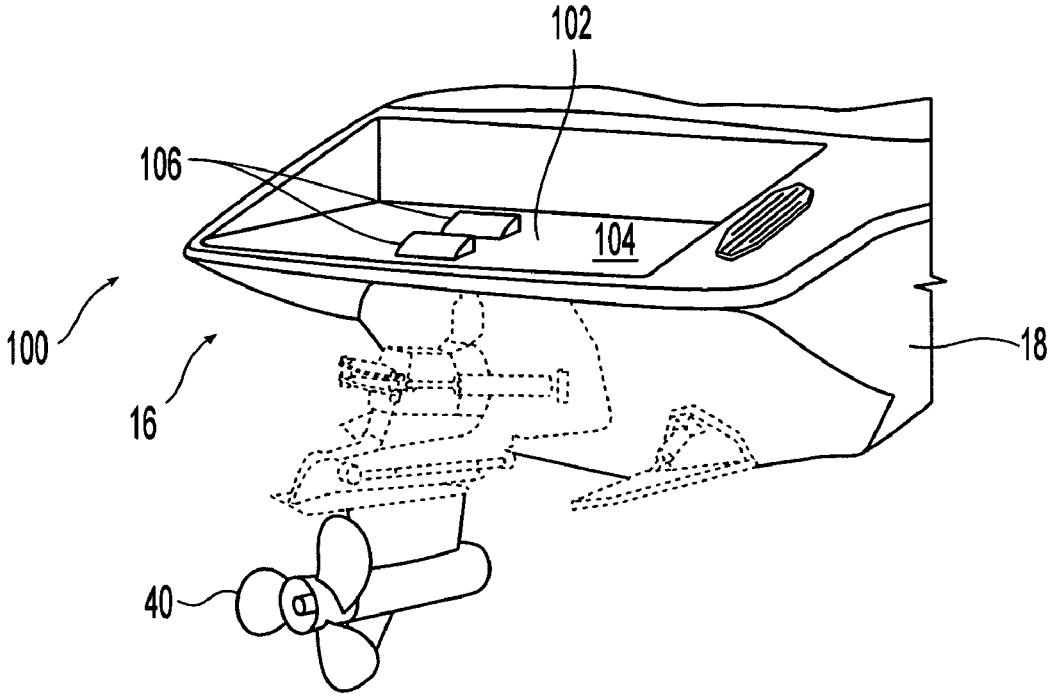
FIG. 4 is a rear perspective view of a second embodiment of a protective platform according to the present invention in a first position.
Figure 5:
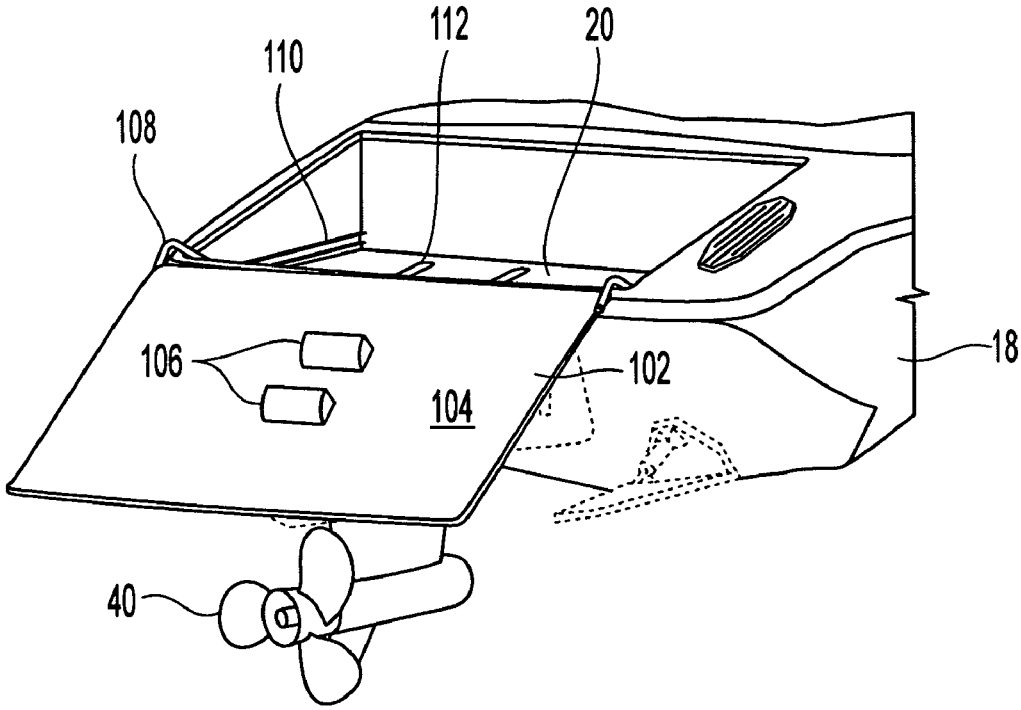
FIG. 5 is a rear perspective view of the protective platform of FIG. 4 in a second position.
Figure 6:
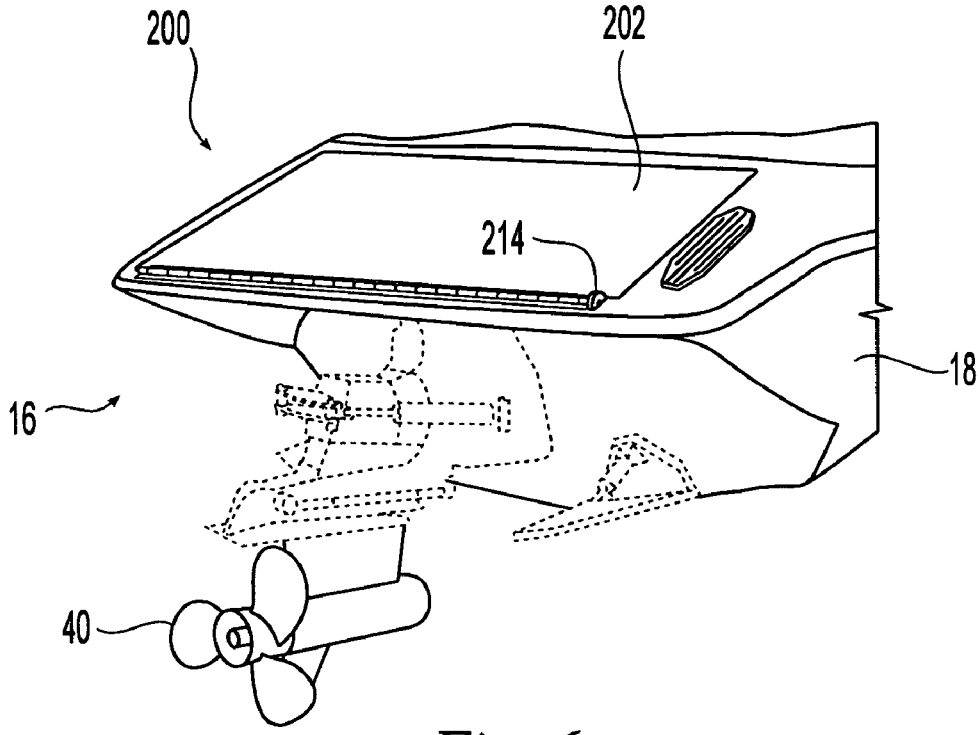
FIG. 6 is a rear perspective view of a third embodiment of a protective platform according to the present invention in a first position.
Figure 7:
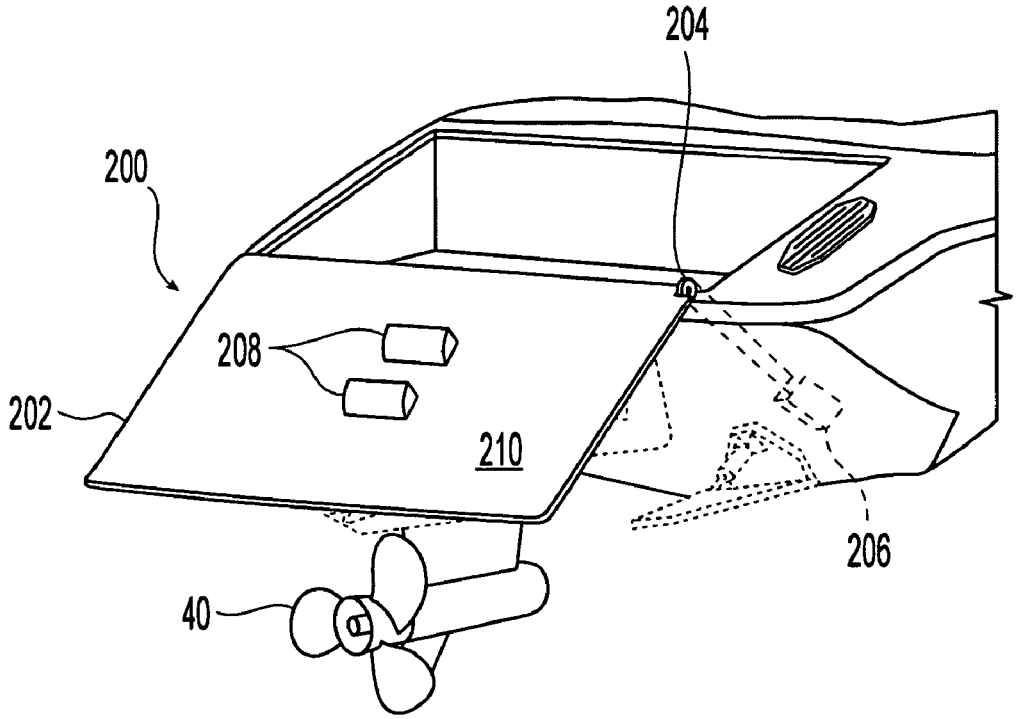
FIG. 7 is a rear perspective view of the protective platform of FIG. 6 in a second position.
Figure 8:
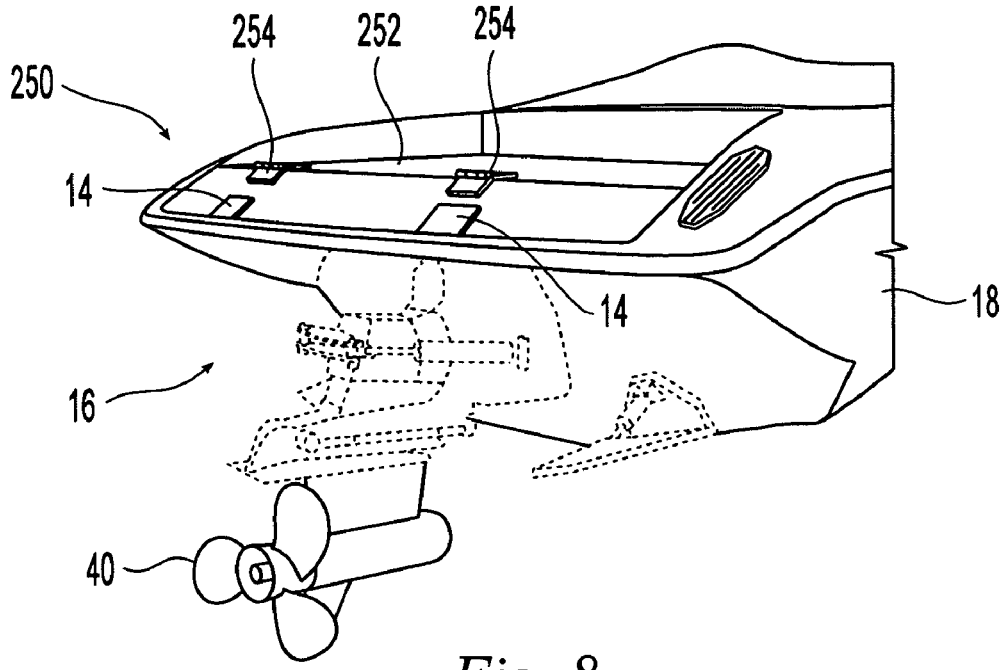
FIG. 8 is a rear perspective view of a fourth embodiment of a protective platform according to the present invention in a first position.
Figure 9:
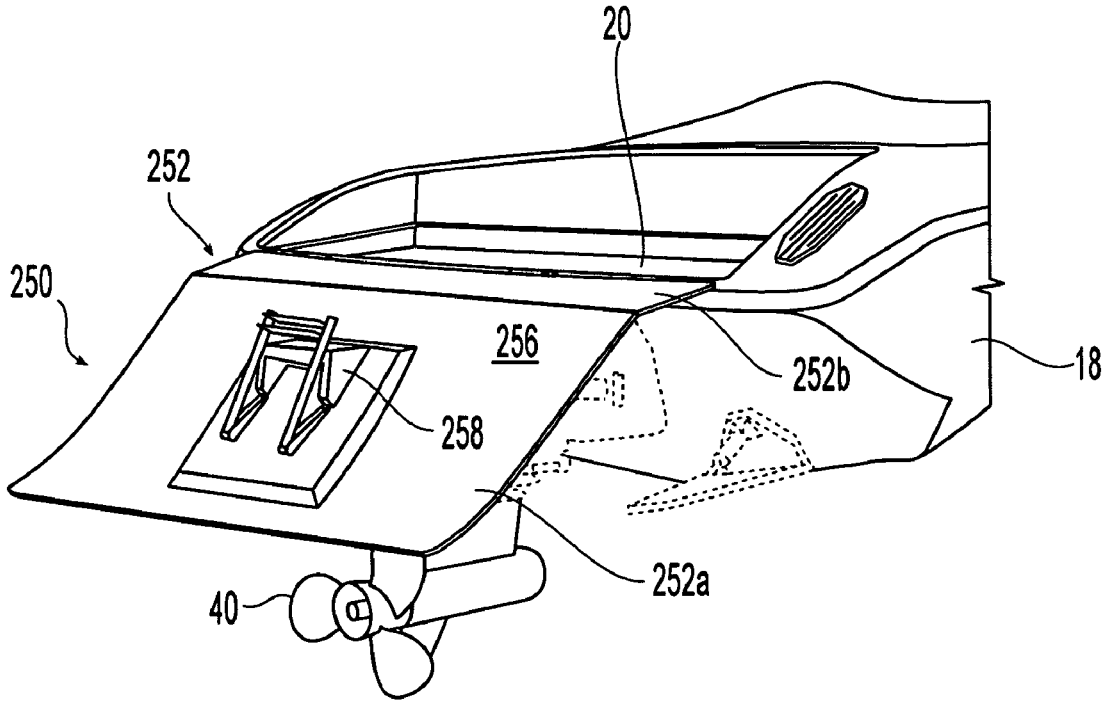
FIG. 9 is a rear perspective view of the protective platform of FIG. 8 in a second position.
Figure 10:
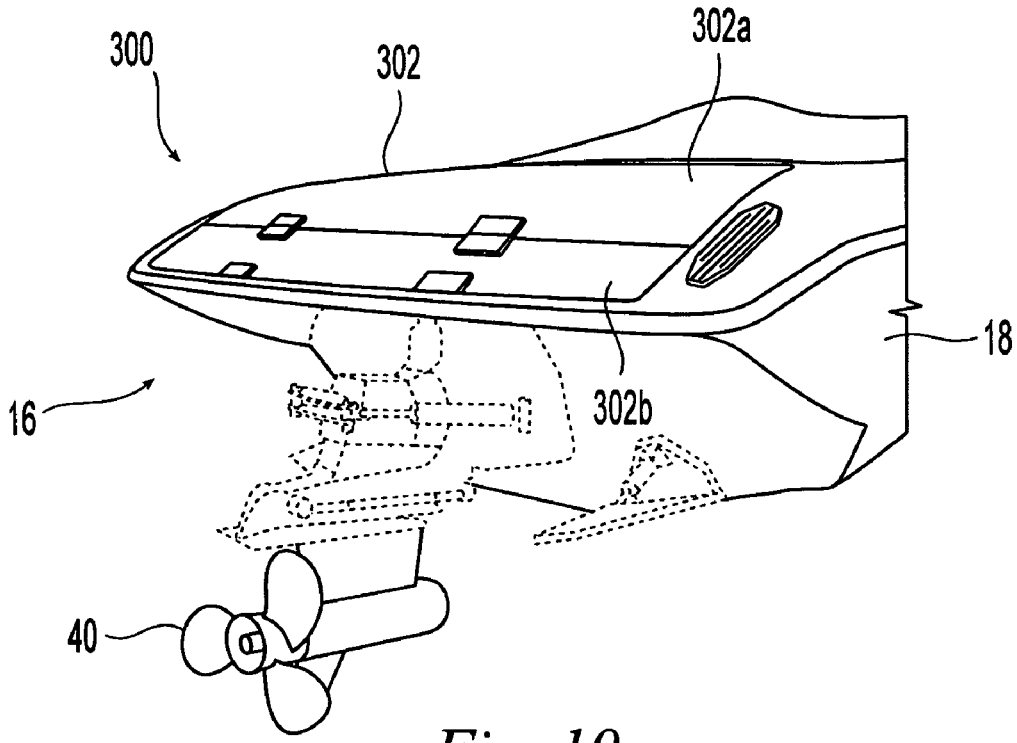
FIG. 10 is a rear perspective view of a fifth embodiment of a protective platform according to the present invention in a first position.
Figure 11:
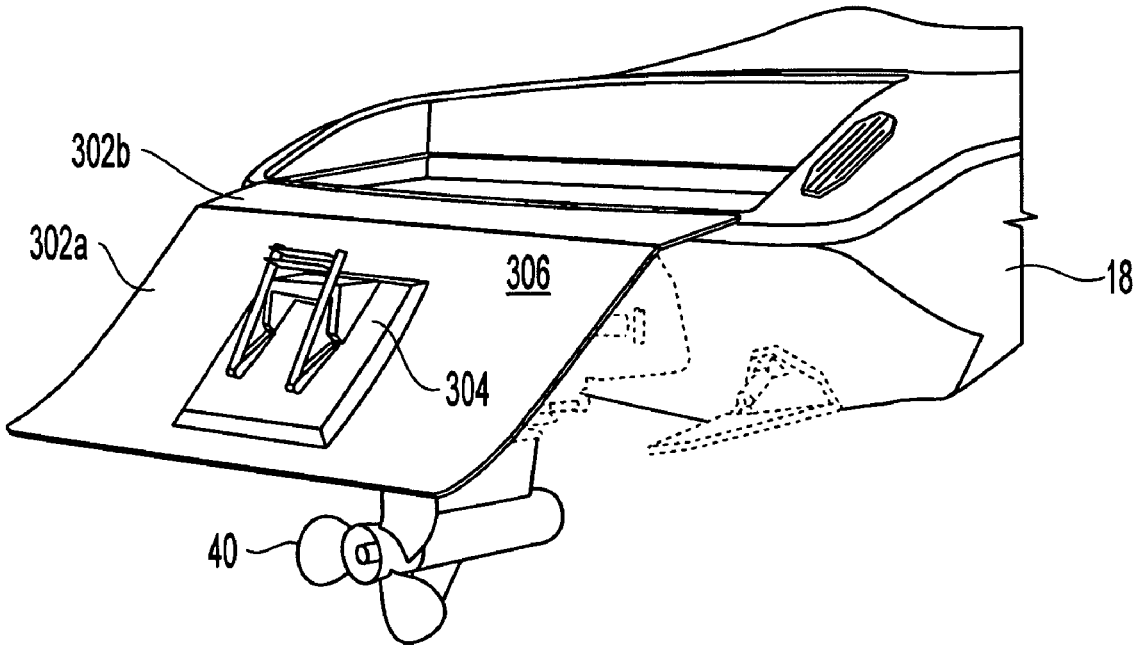
FIG. 11 is a rear perspective view of the protective platform of FIG. 10 in a second position.
Figure 12:
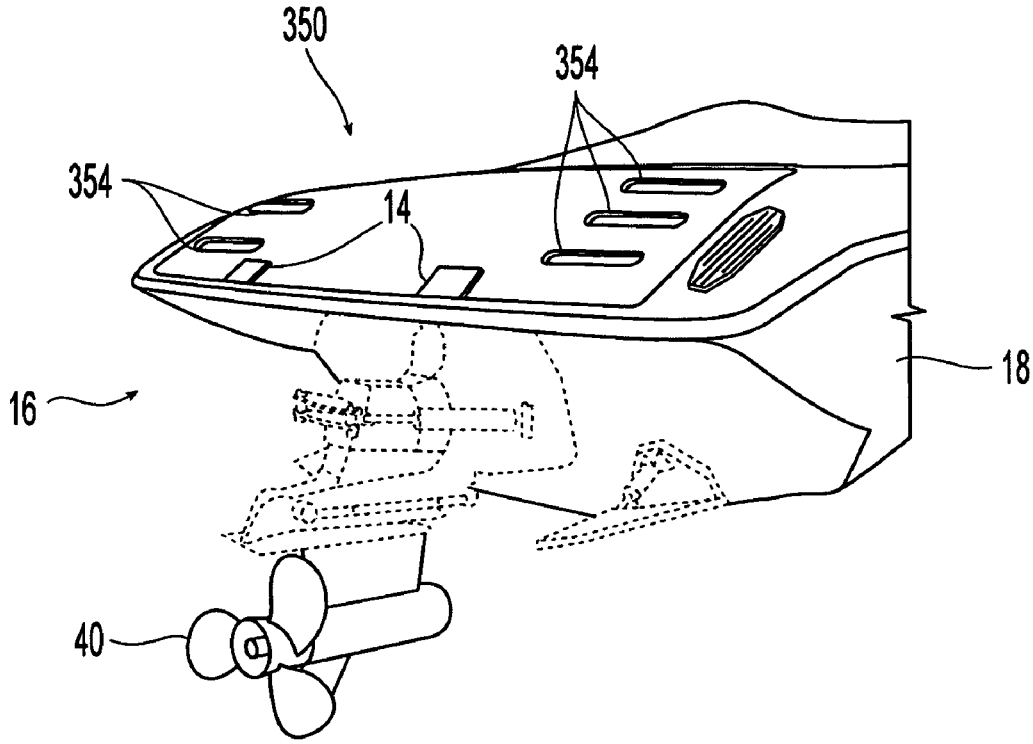
FIG. 12 is a rear perspective view of a sixth embodiment of a protective platform according to the present invention in a first position.
Figure 13:
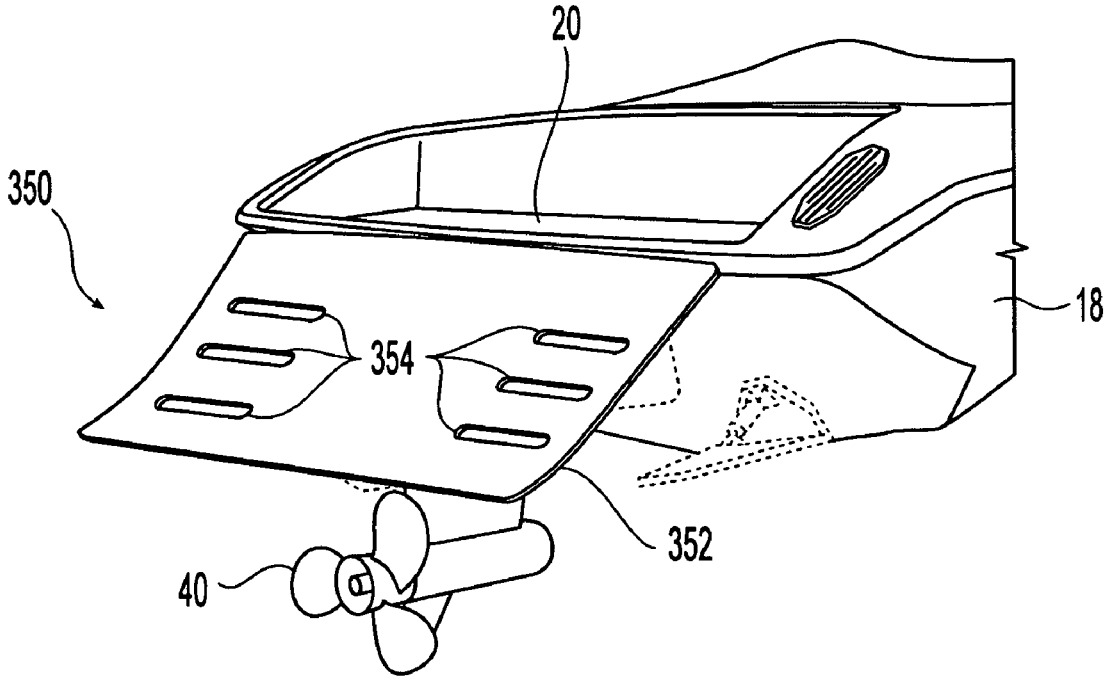
FIG. 13 is a rear perspective view of the protective platform of FIG. 12 in a second position.
Figure 14:
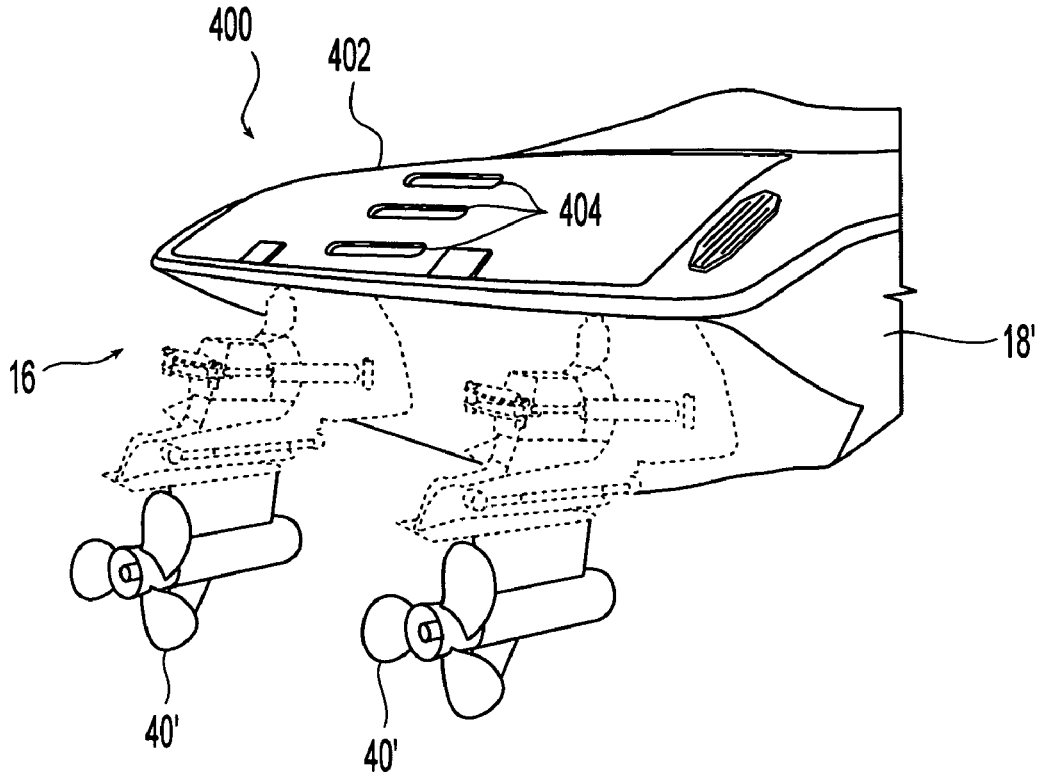
FIG. 14 is a rear perspective view of a seventh embodiment of a protective platform according to the present invention in a first position.
Figure 15:
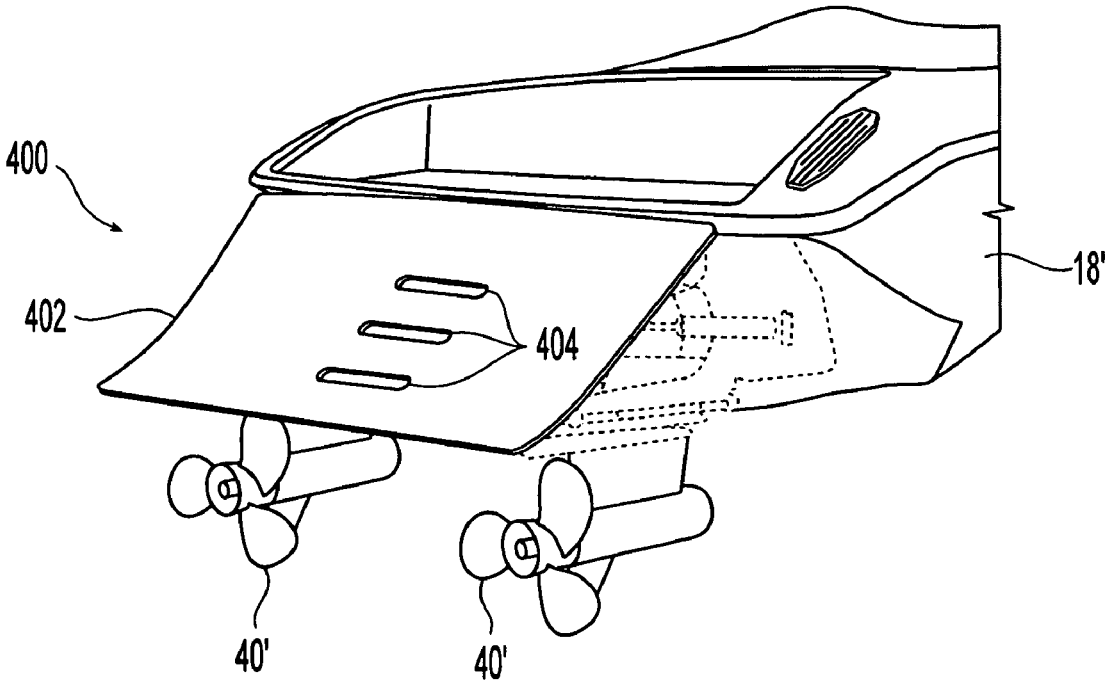
FIG. 15 is a rear perspective view of the protective platform of FIG. 12 in a second position.

FIGS. 1-3 schematically illustrate one preferred embodiment of a protective platform as disclosed herein, which also acts as a cover for a swim platform. FIGS. 4 & 5 schematically illustrate another preferred embodiment of a protective platform as disclosed herein. FIGS. 6 & 7 schematically illustrate a third preferred embodiment of a protective platform as disclosed herein, which also acts as a cover for a swim platform. FIGS. 8 & 9 schematically illustrate another preferred embodiment of a protective platform as disclosed herein, which also acts as a cover for a swim platform. FIGS. 10 & 11 schematically illustrate another preferred embodiment of a protective platform as disclosed herein, which also acts as a cover for a swim platform. FIGS. 12 & 13 schematically illustrate another preferred embodiment of a protective platform as disclosed herein, which also acts as a cover for a swim platform. FIGS. 14 & 15 schematically illustrate another preferred embodiment of a protective platform as disclosed herein, which also acts as a cover for a swim platform.

The protective platform 10 preferably has a solid panel 12 that is attached by hinges 14 to the stern 16 of a boat 18. The protective platform 10 also preferably moves between a first position, which is illustrated in FIG. 1 as being in a closed position that at least partially covers a swim platform 20 on the stern 16 of the boat 18. As illustrated in FIG. 1, the panel 12 preferably has the same general shape of the boat 18 at the stern 16 to provide a more aerodynamic and polished look. The panel 12 preferably has a step or ladder 20 to assist swimmers to climb up the protective platform 10 and enter the boat 18. As such, the protective platform 10 also functions as a cover for the stern 16 of the boat 18. As illustrated in FIGS. 1-3, the ladder 20 preferably has a fixed step 22 attached to an inside surface 24 (or lower surface in the closed position) of the panel 12. The ladder 20, as illustrated best in FIG. 3, also preferably has a foldable portion 26 with additional stepping surfaces that extends farther down the protective platform 10. However, it should be noted that the foldable portion 26 may be the only stepping surface on the protective platform 10, or the fixed step 22, which may have more than the one step as illustrated in FIGS. 1-3, may be the only stepping surface(s) on the protective platform 10.

The protective platform 10 preferably has a mechanism to move the panel 12 between the first and second positions, although it may also be done manually. As illustrated in FIGS. 1-3, one such mechanism is a winch 30 with an arm 32 to provide appropriate pivot points for the wire or cable 34 to pull the panel 12 up from the second position (as best illustrated in FIG. 3) around the hinges 14 and to the first position (FIG. 1). The winch 30 also has a spring 36 attached to the arm 32 to assist in moving the arm 32 as the panel 12 is raised or lowered. However, any other appropriate mechanism may be used with the winch 30, and may be located in any appropriate position on the panel 12. For example, there may be two such mechanisms on either side of the panel 12. The end 38 of cable 34 is attached to an appropriate motor or other mechanism (not shown) to retrieve and extend the cable 34 as required. It should noted that the protective platform 10 preferably rotates at least about 180° and more preferably about 200° between the first and second positions. The rotational amount will depend on the configuration of the stern 16 of the boat 18—the sleeker and more aerodynamic the boat (i.e., a flatter boat), the farther the protective panel 10 will need to rotate about the hinges 14 to protect the swimmers from the propeller 40.

Turning to FIG. 3, the protective platform 10 is illustrated in the second or lowered position. In this position, the protective platform 10 covers or blocks access to the propeller 40 from the stern 16 of the boat 18. In this second position, it is difficult for a swimmer to have access to the propeller 40 from the stern 16 or even from the sides, given that the protective platform 10 preferably extends substantially all the way across the stern 16 of the boat 18 or the boat's beam. In order for the protective platform 10 to provide adequate protection, the protective platform 10 should extend at least 60% of the boat's beam to reduce the chances that a swimmer could reach the propeller 40 from either side of the protective platform 10, and more preferably it should extend at least 80% of the boat's beam.

While the protective platform 10 is illustrated in FIG. 1 to cover all of the swim platform 20 for a sleeker, more polished look, it need not cover the swim platform 20 or the opening in the stern 16 of the boat 18 in its entirety. Instead, the protective platform 10 may only cover a portion of the swim platform 20, which may be dictated by the length L of the panel 12 needed to protect swimmers from the propeller 40. The larger the boat 18 and the greater the distance from the swim platform 20 to the propeller 40, the longer the panel 12 needs to be.

A second embodiment of a protective platform 100 is illustrated in FIGS. 4-5. The protective platform 100 also has a panel 102 and is illustrated as covering all of the swim platform 20. However, in this embodiment, the protective platform 100 only covers the floor of swim platform 20 and does not conform to the upper surface of the boat 18 at the stern 16. As noted above, the panel 102 need not cover the entirety of the swim platform 20, but only cover a portion thereof.

The panel 102 has an upper surface 104 that has steps 106 that are preferably mounted directly thereon. While the steps 106 are illustrated as being mounted directly on the upper surface 104 and being two independent steps, the steps 106 could be of any appropriate configuration or type or attached to or mounted in the upper surface 104 in any appropriate manner. The steps 106 are mounted on the upper or outer surface 104 because the panel 102 does not rotate around hinges as in the previous embodiment, but instead the panel 102 is attached the boat 18 by sliding elements 108 and the panel 102 slides outward off the stern 16 of the boat 18 and downward into the water. Thus, the upper surface 104 faces the same direction in both the first position (FIG. 4) and the second position (FIG. 5). The sliding elements 108 may be wheels or projections that cooperate with tracks 110, or they may be any other appropriate sliding mechanism. The sliding elements 108 also need not be on the sides of the panel 102 as illustrated, but could also be mounted on the underside of the panel 102 and engage the topside of the swim platform 20.

The swim platform 20 preferably has protective strips 112 on which the protective platform 100 rests and/or slides while over the stern 16 of the boat 18 to keep the protective platform 100 from scratching the deck of the boat 18.

Another embodiment of a protective platform 200 is illustrated in FIGS. 6 and 7. The protective platform 200 has a panel 202 attached to the boat 18 by rod 204 that rotates the protective platform 200 between the first position (FIG. 6) and second position (FIG. 7). The panel 202 has steps 208 attached to an inside or lower surface 210 of the panel 202. As with the previous embodiments the steps 208 may be of any appropriate shape or configuration and attached in any appropriate manner. The rod 204 is connected to a drive mechanism 206 that rotates the rod 204 and the protective platform 200 between the first and second positions. The mechanism 206 to rotate the rod 204 and the protective platform 200 could be a motor with a direct drive or a belt. The mechanism 206 may also be a hydraulic drive that causes the rod to rotate between the first and second positions. In fact, any type of drive mechanism may be used to rotate the rod 204.

Another embodiment of protective platform 250 is illustrated in FIGS. 7 and 8. Protective platform 250 has a panel 252 that is preferably divided into a first portion 252*a* and a second portion 252*b*. In the first position, the first portion 252*a* is generally parallel to the swim platform 20 and is preferably attached to the second portion 252*b* by hinges 254. While the hinges 254 are illustrated as two separate hinges, any configuration, shape, or number of hinges may be used to connect the two portions. The second portion 252*b* is preferably smaller than the first portion 252*a* and generally conforms to the configuration of the boat 18 adjacent the swim platform 20 to provide a smooth, polished look. As illustrated in FIG. 7, the protective platform 250 covers the swim platform 20 in the first position, but first portion 252*a* does not lie on swim platform 20 as in the embodiment illustrated in FIGS. 4 and 5. Rather, the first portion 252*a* is elevated slightly off the swim platform to allow for steps 258 mounted on the inside or lower surface 256 of the first portion 252*a* to clear the swim platform. In the second position, illustrated in FIG. 9, the protective platform 250 protect swimmers from the propeller 40. As can be seen in the two figures, the panel 252 must rotate about two axes—one axis through each set of the hinges—in order to move between the first and second positions. The steps 258 are preferably similar to those steps illustrated in FIGS. 1-3 for protective platform 10. However, steps 258 could be of any type, style, and/or configuration.

Another embodiment of protective platform 300 is illustrated in FIGS. 10 and 11. The protective platform 300 is similar to the protective platform 250 of FIGS. 8 and 9 and has a panel 302 that is divided into a first portion 302*a* and a second portion 302*b*. The first portion 302*a* is similar to the first portion 252*a* except that first portion 302*a* is not parallel to swim platform 20, but rather it is configured to conform to the outer surface of the boat 18 adjacent the stern 16.

The inside or lower surface 306 of first portion 302*a* also has steps 304 attached thereto. Again, the steps 304 may be of any configuration, style, or attached in any appropriate manner.

Another embodiment of protective platform 350 is illustrated in FIGS. 12 and 13. The protective platform 350 has a panel 352 that is preferably attached to the stern 16 of the boat 18 by hinges 14. It should be noted, however, that the protective platform 350 can be attached to the stern 16 of the boat 18 in any appropriate manner, including any of those discussed above, and may be moved from the first position (FIG. 12) to the second position (FIG. 13) by any appropriate mechanism, including those noted above. The panel 352 preferably has openings 354 through the panel 352 that can be used by swimmers as stepping surfaces. It should be noted that the openings 354 are positioned on the panel 352 away from the central location of the propeller 40. In other words, the openings 354 are positioned in panel 352 on opposite edges of the panel 352. While there are six openings 354 illustrated in the figures and are being generally narrow and oblong, the openings 354 may be of any size, shape, configuration, and number and located at any appropriate location.

The protective platform 350 may also have steps as illustrated in any of the previous figures and/or embodiments (e.g., 22, 106). It should also be noted that any of the panels (e.g., 12, 102, 202, 252, 302) may also have openings, such as openings 354, rather than, or in addition to, the steps or ladder.

Another embodiment of a protective platform 400 is illustrated in FIGS. 14 and 15. The protective platform 400 has panel 402 preferably with three openings 404 in the center of the panel 402 because the boat 18' as two propellers 40' located toward the sides of boat 18' rather than the single, centrally located propeller 40 in the prior embodiments. Therefore, the openings 404 are located in the middle portion of the panel 402 so that the swimmers when approaching a protective platform 400 are not in the vicinity of the propellers 40'. Again, the openings 404 may be of any size, shape, configuration, and number and located at any appropriate location on panel 402.

It should be noted that the protective platforms disclosed and illustrated herein may also function only as a cover for the swim platform if the boat owner so desires. That is, the swim platforms may be too small (not deep enough for the distance between the swim platform and the propeller(s)) to have a protective platform that is large enough to prevent access to the propeller of the boat. In that case, the protective platform may not provide a maximum amount of protection for swimmers, or any at all. In that case, the protective platforms function as a cover for the swim platforms only. In that case, the protective platforms may be used to secure other items in the stern of the boat (i.e., a bar, an entertainment center, etc.).

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A protective platform to protect swimmers from a boat's propeller comprising:

a panel movably attached to the stern of the boat, the panel movable between a first resting position and a second resting position, the second resting position at least partially providing protection to swimmers from the boat's propeller; and at least one stepping surface on the panel to assist the swimmers from the water to a swim platform on the boat.

2. The protective platform according to claim 1, wherein the panel covers at least a portion of the swim platform when in the first resting position.

3. The protective platform according to claim 1, wherein the panel is rotatable between the first resting position and the second resting position.

4. The protective platform according to claim 1, wherein the panel slides to move between the first resting position and the second resting position.

5. The protective platform according to claim 1, wherein the stepping surface is on a upper surface of the panel when the panel is in the first resting position.

6. The protective platform according to claim 1, wherein the stepping surface is on a lower surface of the panel when the panel is in the first resting position.

7. The protective platform according to claim 1, wherein the panel generally corresponds to a surface of the boat adjacent the swim platform, the panel thereby hiding at least a portion of the swim platform from view when the panel is in the first resting position.

8. The protective platform according to clam 1, wherein the stepping surface is at least one rung of a ladder.

9. The protective platform according to claim 1, wherein the panel extends across at least 60% of the boat's beam.

10. The protective platform according to claim 1, wherein the panel rotates about two different axes to move between the first resting position and the second resting position.

11. A movable cover for a swim platform on a boat comprising:

a panel for covering at least a portion of a swim platform on a boat;

at least one hinge rotatably connecting the panel to the boat, the panel being rotatable between a first resting position and a second resting position and covering at least a portion of the swim platform in the first resting position;

a stepping surface on a surface of the panel; and a mechanism to move the panel between the first resting position and the second resting position.

12. The movable cover according to claim 11, wherein the mechanism is a winch.

13. The movable cover according, to claim 11, wherein the mechanism is attached to a rod connected to the panel.

14. The movable cover according to claim 11, wherein the mechanism is a hydraulically operated mechanism.

15. The movable cover according to claim 11, wherein the stepping surface is on an inside surface of the panel when the panel is in the first position.

16. The movable cover according to claim 11, wherein the panel rotates at least 180° between the first position and the second position.

17. The movable cover according to claim 11, wherein an outside surface of the panel conforms generally to the configuration of a surface of the boat adjacent the swim platform.

18. A movable cover for a boat comprising:

a panel for covering at least a portion of a rear portion of a boat, the panel being movable between a first resting position and a second position, the panel covering at least a portion of a substantially horizontal portion of the boat in the first resting position;

a stepping surface attached to a surface of the panel; and a mechanism to move the panel between the first resting position and the second position.

19. A movable cover for a rear portion of a boat comprising:

at least one panel for covering at least a portion of the rear portion of the boat, the at least one panel having a surface generally corresponding to a surface of the boat adjacent the rear portion of the boat;

means for movably attaching the at least one panel to the boat at a rear portion thereof; and a mechanism to move the at least one panel between a first position and a second position, the at least one panel covering at least a portion of the rear portion of the boat in the first position.

20. The movable cover according to clam 19, wherein a the at least one panel comprises two panels.

21. A movable cover for a boat comprising:

a panel for covering at least a portion of a rear portion of the boat, the panel being movable between a first resting position and a second position, the panel covering at least a portion of a substantially horizontal portion of the boat in the first resting position;

at least one hinge rotatably connecting the panel to the boat; and a mechanism to rotate the panel between the first resting position and the second position, the panel rotating at least 180° between the first position and the second position.

* * * * *